United States Patent [19]

Sasaki et al.

[11] Patent Number: 5,072,702

[45] Date of Patent: Dec. 17, 1991

[54] ENGINE SHUT-DOWN DEVICE

[75] Inventors: Asao Sasaki, Noda; Masami Minegishi, Urawa, both of Japan

[73] Assignee: Fuji Jukogyo Kabushiki Kaisha, Tokyo, Japan

[21] Appl. No.: 544,226

[22] Filed: Jun. 26, 1990

[30] Foreign Application Priority Data

Jun. 29, 1989 [JP] Japan ..... 1-76971
Jun. 29, 1989 [JP] Japan ..... 1-167646

[51] Int. Cl.[5] ..... F02D 17/04; F02N 11/10
[52] U.S. Cl. ..... 123/179.4; 123/198 DB
[58] Field of Search ..... 123/179 B, 179 A, 179 R, 123/198 DB, 198 DC, DIG. 11

[56] References Cited

U.S. PATENT DOCUMENTS

| | | | |
|---|---|---|---|
| 3,482,562 | 12/1969 | Ranft | 123/DIG. 11 |
| 3,681,658 | 8/1972 | Naoi et al. | 123/179 R |
| 3,712,283 | 1/1973 | Kiess et al. | 123/179 B |
| 4,073,279 | 2/1978 | Fox | 123/198 DC |
| 4,338,896 | 7/1982 | Papasideris | 123/198 DB |
| 4,924,827 | 5/1990 | Minegishi | 123/198 DB |

FOREIGN PATENT DOCUMENTS

| | | | |
|---|---|---|---|
| 53-24922 | 3/1978 | Japan | 123/198 DB |
| 55-125338 | 9/1980 | Japan | 123/198 DB |

*Primary Examiner*—Andrew M. Dolinar
*Attorney, Agent, or Firm*—Beveridge, DeGrandi & Weilacher

[57] ABSTRACT

An engine shut-down control device comprises a shut-down controller for outputting an engine shut-down signal in dependency on a rotation signal generated by an engine rotation when a key switch is turned off and for maintaining self-hold operation until the rotation signal stops, and a start controller for non-electrifying a starter while the rotation signal is output regardless of the position of the key switch. When the key switch is turned off, the shut-down controller automatically holds the device by outputting the engine shut-down signal in dependency on the rotation signal generated from the engine rotation. Namely, the engine shut-down signal is output until the engine completely stops and output of the rotation signal is stopped.

6 Claims, 5 Drawing Sheets

ENGINE SHUT-DOWN DEVICE

BACKGROUND OF THE INVENTION

The present invention relates to an engine shut-down control device for controlling starting and stopping of an automotive engine, and more particularly to a device for prohibiting stopping and/or restarting the engine before the engine stops completely.

Some methods have been formerly proposed in order to stop engines such as diesel engines. One method is to cut the fuel supply by a stop lever or to stop the intake air supply by shutting a valve provided in an intake pipe.

For example, a key switch actuates a solenoid for stopping a fuel injection pump, and which is disclosed in the Japanese utility model publication No.61-167436 (1986) and No. 61-171843 (1986) as a prior art.

According to the prior art disclosed above, the key switch must be kept in electrical contact with the accessory terminal until the engine is stopped. However, returning the switch is easily forgotten, so that the battery is unnecessarily discharged.

In order to eliminate such an inconvenience as described above, there has been proposed a device to stop the engine by using a timer 1 as shown in FIG. 1, and which is disclosed in detail in Japanese patent publication No. 56-1464 (1981).

Namely, the timer 1 starts its operation at the same time as when an engine is stopped and a key switch is turned off. A solenoid controller controls a solenoid to be supplied with electric power from a power source during operation of the timer. Therefore, the solenoid actuates a fuel cut lever to forcibly cut the fuel supply so as to stop the engine.

However, in this prior art, the operational time of the timer must be set to the necessary and longest time in consideration of discrepancies between engines. The timer is constructed so that operation thereof is given priority to be reset so as not to electrify the solenoid when the key switch is turned on erroneously or the condition that the engine does not stop completely while the timer operates. As a result, it is possible to damage the starter by large loads even if the operator starts the starter under the above conditions.

Also, in gasoline engines, the same problem as mentioned above occurs if the operator operates the starter erroneously when the engine does not stop completely during idling or after turning off the key switch.

Furthermore, a conventional diesel engine has the problem of wasting electric power by keeping the solenoid turned on after the engine stops during the operation time of the timer. The operation time is set at the longest time to stop the engine after cutting the fuel supply taking into consideration the difference between engines.

SUMMARY OF THE INVENTION

From the viewpoint of the above-mentioned problem, an object of the present invention is to provide an engine shut-down device capable of avoiding trouble in the unintentional starting of an engine by means of inhibiting the operation of a starter while the engine is not completely stopped.

Another object of the present invention is to provide a shut-down device for a diesel engine in which the power consumed for stopping an engine is low and the engine can be stopped completely.

In order to achieve the above-mentioned objects, an engine shut-down device according to the present invention comprises a stop controller for outputting an engine shut-down signal in dependency on a rotation signal generated by an engine rotation when a key switch is turned off, and maintaining self-hold operation until the rotation signal stops.

By the above construction, when the key switch is turned off, the stop controller outputs the engine shut-down signal in dependency on the rotation signal of the engine so as to maintain the shutting down of the engine. Namely, the stop controller maintains the output of the engine shut-down signal until the engine completely stops and the rotation signal is stopped.

As an aspect of the present invention, the engine shut-down device further comprises a start controller for non-electrifying a starter while the rotation signal is output regardless of the position of the key switch.

The start controller maintains the non-electrification of the starter while the engine has not stopped and the rotation signal is output. Accordingly, the starter can not be started even if the key switch is operated, and can be started only after the engine completely stops.

As another aspect of the present invention, the engine shut-down device comprises a key switch detector for detecting a key switch condition and outputting an engine start signal when the key switch is turned on, and an operation holder for voiding the engine start signal of the key switch detector while the engine rotates.

DETAILED DESCRIPTION OF THE PREFERRED EMBODIMENTS

Preferred embodiments of the present invention will now be described in detail with reference to attached drawings.

Figure 1:
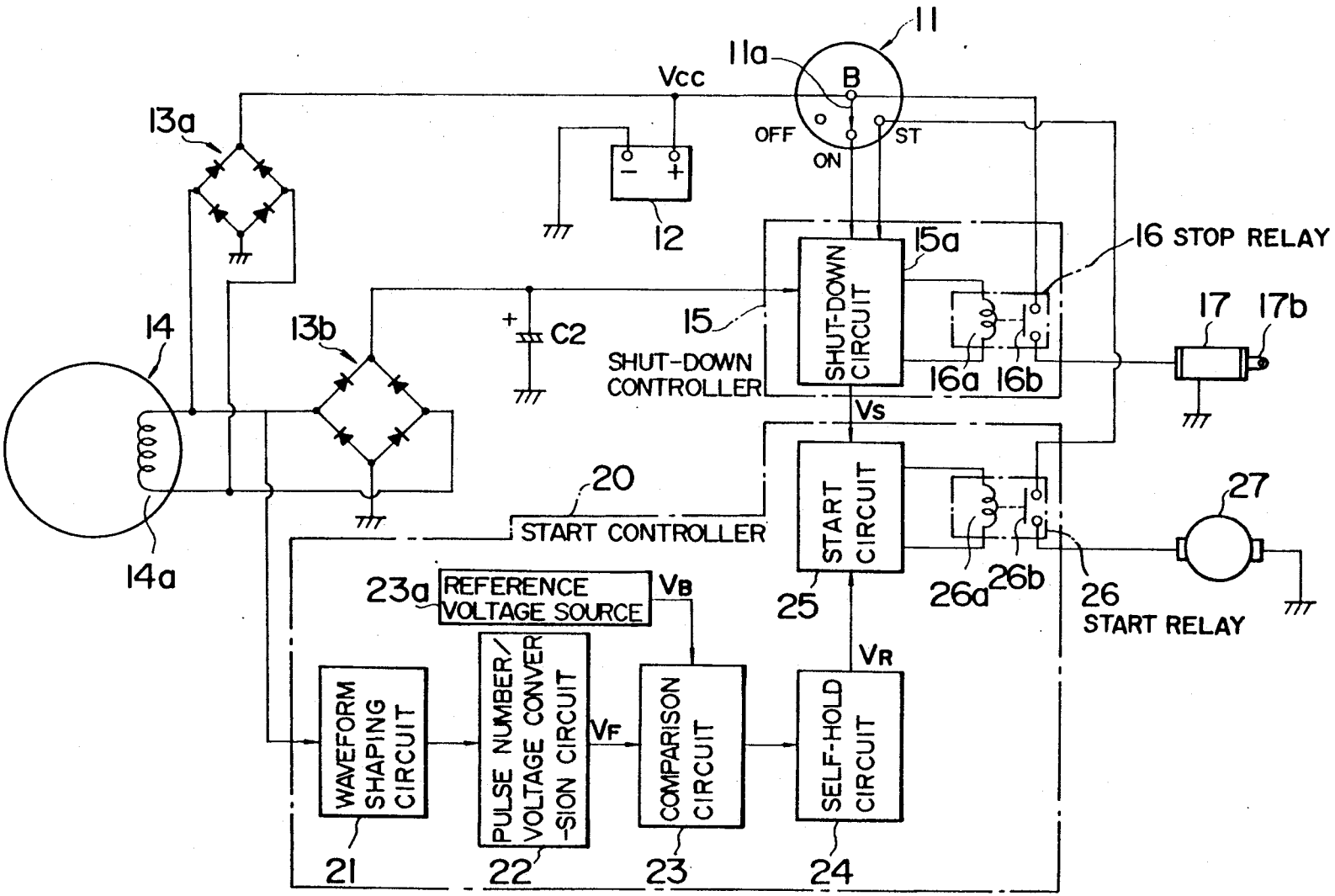
FIG. 1 is a block diagram showing an engine shut-down device of a first embodiment of the present invention.
Figure 2:
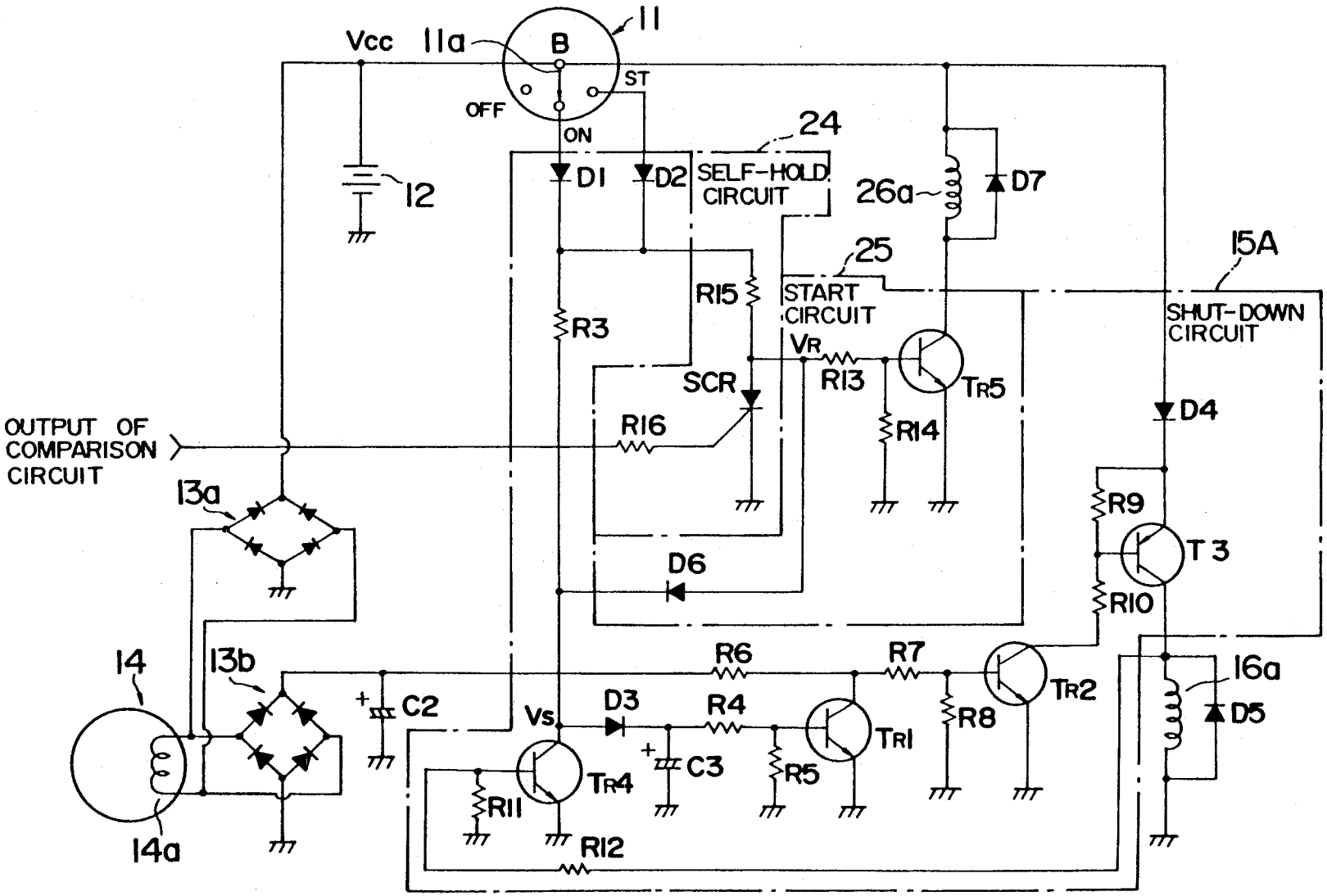
FIG. 2 is a circuit diagram showing a main portion of the shut-down device according to the first embodiment.
Figure 3:
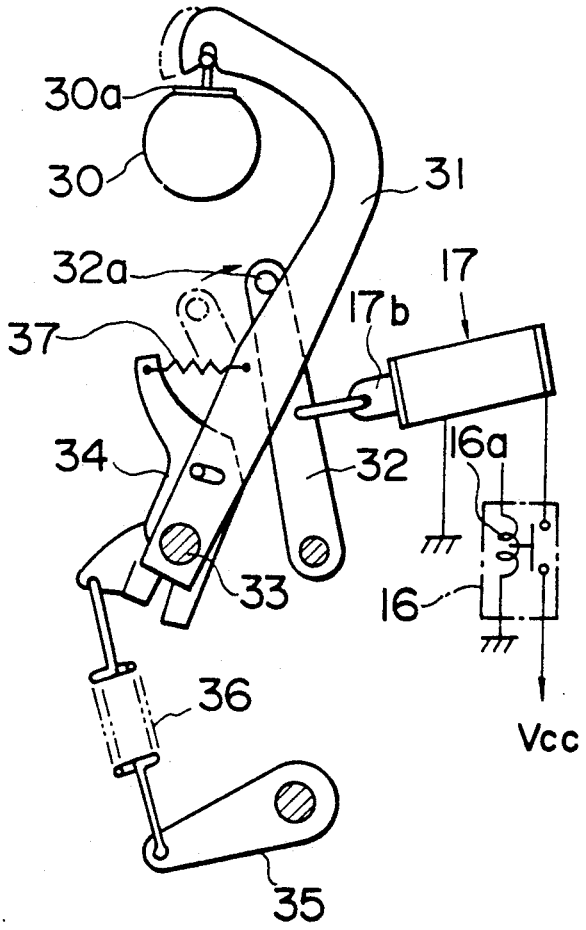
FIG. 3 is a schematic view of a governor of a fuel supply system on which the shut-down device of the first embodiment is mounted.

In a first embodiment, as shown in FIGS. 1 to 3, numeral 11 denotes a key switch having an OFF terminal, an ON terminal, a starter (ST) terminal, a B terminal, and a movable contact 11*a* which is capable of selectively connecting the B terminal with the OFF, ON or ST terminal. The B terminal is connected with a battery 12, and also with a magneto 14 via a rectifier 13*a*. An electric power is supplied from a power source Vcc to the B terminal.

A smoothing capacitor C2 is connected with a rectifier 13 *b* which is connected with a charge coil 14*a* of the magneto 14 and different from the rectifier 13*a*. An alternating current output from the magneto 14 is rectified by the rectifier 13*b* and smoothed by the capacitor C2 so as to be supplied to a shut-down circuit 15A of a shut-down controller 15 as a rotational signal. An excitation coil 16*a* of a stop relay 16 is connected to the shut-down circuit 15A. One of terminals of a relay contact 16*b* of the stop relay is connected to the B terminal of the key switch 11, while the other terminal of the relay contact 16*b* is connected to a solenoid 17 as an engine shut down actuator.

On the other hand, an output of the charge coil 14*a* is directly supplied to a start controller 20 which comprises a waveform shaping circuit 21, a pulse number/-voltage conversion circuit 22, a comparison circuit 23, a self-hold circuit 24, a start circuit 25, and a relay 26.

The waveform shaping circuit 21 is constructed from, for example, a Schmitt circuit. The circuit 21 converts an alternating output wave of the charge coil 14*a* of the magneto 14 into pulse wave by a rectification and outputs the pulse wave to the conversion circuit 22.

The conversion circuit 22 is constructed from, for example, a frequency voltage conversion circuit or a pulse rate circuit. The circuit 22 converts number of the pulse wave, i.e. a pulse frequency, into a voltage value $V_F$ corresponding thereto.

The comparison circuit 23 is constructed from, for example, a comparator. The circuit 23 compares the voltage value $V_F$ converted by the conversion circuit 22 with a reference voltage $V_B$ from a reference voltage setting circuit 23*a*. When the value $V_F$ becomes over the reference value $V_B$, namely, "$V_F > V_B$", the comparison circuit 23 outputs an operational signal such as a high-level signal.

The reference voltage $V_B$ corresponds to an output of the charge coil 14*a* of the magneto 14 at a predetermined engine speed. The comparison circuit 23 determines whether or not an engine speed reaches the predetermined speed, by comparing the voltage value $V_F$ with the reference voltage $V_B$.

The reference voltage $V_B$ from a circuit 23*a* may be generated in the comparison circuit 23 by using a threshold voltage i.e. of a C-MOS circuit.

The self-hold circuit 24 is constructed, for example, a latch circuit such as a digital IC (integrated circuit) or a thylistor. For example, the circuit 24 makes and maintains an output $V_R$ to the low level in dependency on the high-level operational signal from the comparison circuit 23.

Next, an example of a concreat circuitry of the shut-down controller 15 and the start controller 20, is shown in FIG. 2.

In the shut-down controller 15, the ON terminal and the ST terminal of the key switch are connected with each other through diodes D1 and D2, respectively. A resistor R3 is connected with a connecting point cf the diodes D1 and D2. A capacitor C3 is connected with the resistor R3 through a diode D3.

A resistor R4 is connected with a connecting point of the capacitor C3 and the diode D4, and connected to a base of an NPN type transistor TR1 and a bias resistor R5.

A resistor R6 is connected to the smoothing capacitor C2 which is connected to the rectifier 13*b* connected with the charge coil 14*a* of the magneto 14. The resistor R6 is connected to a collector of the transistor TRl. A resistor R7 is connected to a connecting point of the resistor R6 and the collector of the transistor TR1. The resistor R7 is also connected to a base of an NPN type transistor TR2 and a bias resistor R8.

On the other hand, an emitter of a PNP type transistor TR3 is connected to the B terminal of the key switch 11 through a diode D4. The diode D4 is also connected to resistors R9 and R10 which are connected in series and also connected to a collector of the transistor TR2.

An emitter and a base of the transistor TR3 are biased through the resistor R9. A diode D5 is connected in parallel with the excitation coil 16*a* cf the stop relay 16. The coil 16*a* is connected to a collector of the transistor TR3.

A collector of an NPN type transistor TR4 is connected to a connecting point of the resistor R3 and the diode D3. A base of the transistor TR4 is connected with a bias resistor R11, and also with the collector of the transistor TR3 through a resistor R12.

In the start circuit 25, a cathode of a diode D6 is connected with the collector of the transistor TR4 in the shut-down circuit 15A, and an anode of the diode D6 is connected with a base of an NPN type transistor TR5 through a resistor R13. A bias resistor R14 is also connected with the base of the transistor TR5. Emitters of the transistors TR1, TR2 and TR4 are grounded, respectively.

The excitation coil 26*a* of the starting relay 26 is connected between the B terminal of the switch 11 and a collector of the transistor TR5. A diode D7 is connected in parallel with the coil 26*a* for absorbing a surge voltage of the coil 26*a*. An emitter of the transistor TR5 is grounded.

The self-hold circuit 24 is constructed by a thyrister SCR. An anode of the thyrister SCR is connected with the ON terminal and the ST terminal respectively through the diode D1 and the diode D2. A resistor R15 is installed between both diodes D1 and D2 and the anode of the thyrister SCR. The anode of the thyrister SCR is also connected to the base of the transistor TR5 of the start circuit 25 through the resistor R13.

Furthermore, a gate of the thyrister SCR is connected with the comparison circuit 23 through a resistor R16. The thyrister SCR holds a comparison output from the comparison circuit 23 until the key switch 11 is turned off.

As shown in FIG. 3, the solenoid 17 has a plunger 17*b* which is connected with a middle portion of a stop lever 32. The lever 32 forcibly rotates a governer lever 31 through a pin 32*a* to a stop position (shown by a solid line in FIG. 3). The lever 31 is connected with a control rack 30*a* to set an injection quantity of a fuel injection pump 30.

The plunger 17*b* of the solenoid 17 is projecting at a normal operation of the engine. The stop lever 32 exists at the position apart from the governor lever 31 as shown by a dot-and-dush line in the figure.

A governor weight (not shown in the figure) opposes a governor shaft 33 supporting the governor lever 31. The weight forces the governor shaft 33 in a direction of a low speed (the clockwise direction in FIG. 3) by a centrifugal force according to the engine rotation. A control link 34 is connected with the governor lever 31 through a spring 37 and also with a control lever 35 through a governor spring 36.

Next, there is described an operation of the device of the first embodiment of the present invention having the above-mentioned construction.

First, when the movable contact 11*a* of the B terminal is changed over from the OFF terminal to the ON terminal in the key switch 11, the charging current is supplied from the battery 12 to the capacitor C3 through the diodes D1 and D3 and the resistor R3 under the condition where the transistor TR4 is turned off. The capacitor C3 supplies a voltage to the base of the transistor TR1.

The transistor TR1 is turned on by the voltage of the capacitor C3, and a base voltage of the next transistor TR2 becomes to a substantially ground level so as to be turned off. Accordingly, the final transistor TR3 is also turned off so as to maintain both the stop relay 16 and solenoid 17 to be turned off.

At the same time, the output $V_F$ of the conversion circuit 22 is zero, the output of the comparison circuit 23 is the low level, and the thyrister SCR of the self-hold circuit 24 is turned off in the start controller 20 because the engine does not rotate and the charge coil 14*a* of the magneto 14 does not output the rotational signal. Accordingly, a current flows from the power source Vcc through the resistors R15 and R13 to the resistor R 4 and the base of the transistor TR5, so that both the transistor TR5 and the start relay 26 are turned on.

Accordingly, when the contact 11*a* is connected to the ST terminal in the key switch 11, the starter 27 is actuated to start the engine. After the start of the engine, the contact 11*a* is returned to the ON terminal. An alternating voltage is generated in the charge coil 14*a* of the magneto 4 when the engine starts. The voltage is rectified by a full-wave rectification by the first rectifier 13*a* and charged in the battery 12.

An output of the other rectifier 13*b* is smoothed by the capacitor C2 and supplied to the shut-down circuit 15A. A base current is supplied to the transistor TR1 through the diodes D1 and D3 and the resistor R3 of the shut-down circuit 15A so as to turn on the transistor TR1. Since the capacitor C2 is discharged through the resistor R6 and transistor TR1 to be turned on, the next transistor TR2 is kept turned off.

At the same time, an output of the charge coil 26*a* is converted into pulse signals by the waveform shaping circuit 21. The conversion circuit 22 converts the number of the pulse signals into the voltage $V_F$. The voltage $V_F$ is compared with the reference voltage $V_B$ by the comparison circuit 23. When the engine speed reaches to the predetermined speed and the voltage $V_F$ becomes over the reference voltage $V_B$, namely, "$V_F > V_B$", the comparison circuit 23 inverts the output from the low level to the high level.

The output of the comparison circuit 23 is supplied through the resistor R16 to the gate of the thyrister SCR of the self-hold circuit 24 to turn on the thyrister SCR. The thyrister SCR holds the voltage $V_R$ of the anode to the substantially ground level, thereby turning off the transistor TR5 of the start circuit 25. Accordingly, the start relay 26 is turned off, thereby maintaining the starter 27 in a non-electrified condition after that.

For ordinary operation, the engine speed is controlled to a constant condition by the governor shaft 33 and the lever 31 controlling the position of the control rack 30*a* of the fuel pump 30 in dependency on a balance of the centrifugal force of the flyweight (not shown) and urging force of the governor spring 36.

When the contact 11*a* changes from ON to OFF terminals for stopping the engine, the transistor TR1 of the shut-down circuit 15A is turned off by cutoff the base current.

The output of the second rectifier 13*b* flows through the resistor R6, R7 and R8 in the shut-down circuit 15A, so that the transistor TR2 is turned on by the base current in dependency on a bias of the transistor TR2 by the resistor R8.

Accordingly, the final transistor TR3 is turned or so as to supply the current from the battery 12 to the excitation coil 16*a* of the stop relay 16. The current of the battery 12 is supplied to the excitation coil 17*a* of the solenoid 17 because the relay contact 16*b* is turned on.

As a result, the plunger 17*b* of the solenoid 17 pulls the stop lever 32 in the clockwise direction as shown in FIG. 3, thereby forcibly rotating the governor lever 31 in the same direction, namely, in a direction to shut down the engine. Therefore, a fuel supply is interrupted by a movement of the control rack 30*a* connected to the governor lever 31.

At the safe time, the collector of the transistor TR3 becomes to the high level corresponding to the ON operation of the stop relay 16. The base bias voltage is supplied to the base of the transistor TR4 through the resistor R11 because the collector of the transistor TR3 is connected with the base of the transistor TR4, so that the transistor TR4 is turned on and the collector voltage $V_S$ thereof becomes to the ground level.

Then, the engine speed decreases to reduce the output of the charge coil 14*a* of the magneto 14, so that the output $V_F$ of the conversion circuit 22 becomes under the reference voltage $V_B$ ($V_F < V_B$). As the output of the comparison circuit 23 is inverted from high to low levels and the transistor TR4 is turned on, the base voltage of the transistor TR5 in the start circuit 25 is maintained to substantially ground level even the thyristor SCR of the self-hold circuit 24 is turned off.

Accordingly, even if the contact 11*a* is connected with the ON terminal by the wrong operation before the engine completely stops, the engine is certainly stopped because the current flowing from the source Vcc through the diode D1 and the resistor R3 is grounded by the transistor TR4 in the shut-down circuit 15A, because the transistors TR2 and TR3 are maintained to be ON state while the transistor TR1 is turned off, and because the stop relay 16 is kept to the ON state.

Even if the contact 11*a* is connected to the ST terminal before the engine completely stops, since the transistor TR5 in the start circuit 25 is kept to the OFF state, the power supply to the starter 27 is interrupted, thereby avoiding the damage of the starter 27 previously.

The transistors TR2, TR3 and TR4 are turned off when the engine completely stops and the output from the charge coil 14*a* (namely, the output of the rotation signal) stops, thereby turning off the stop relay 16 so as to stop the current supply to the excitation coil 17*a* of the solenoid 17. Then, the solenoid 17 returns to the initial position.

Accordingly, since the solenoid 17 is turned off immediately after the engine completely stops, it is possible to avoid the wasteful consumption of the electric power. Furthermore, as the transistor TR5 of the start circuit 25 is turned on again by operating the key switch 11*c*, it is possible to restart the engine.

Figure 4:
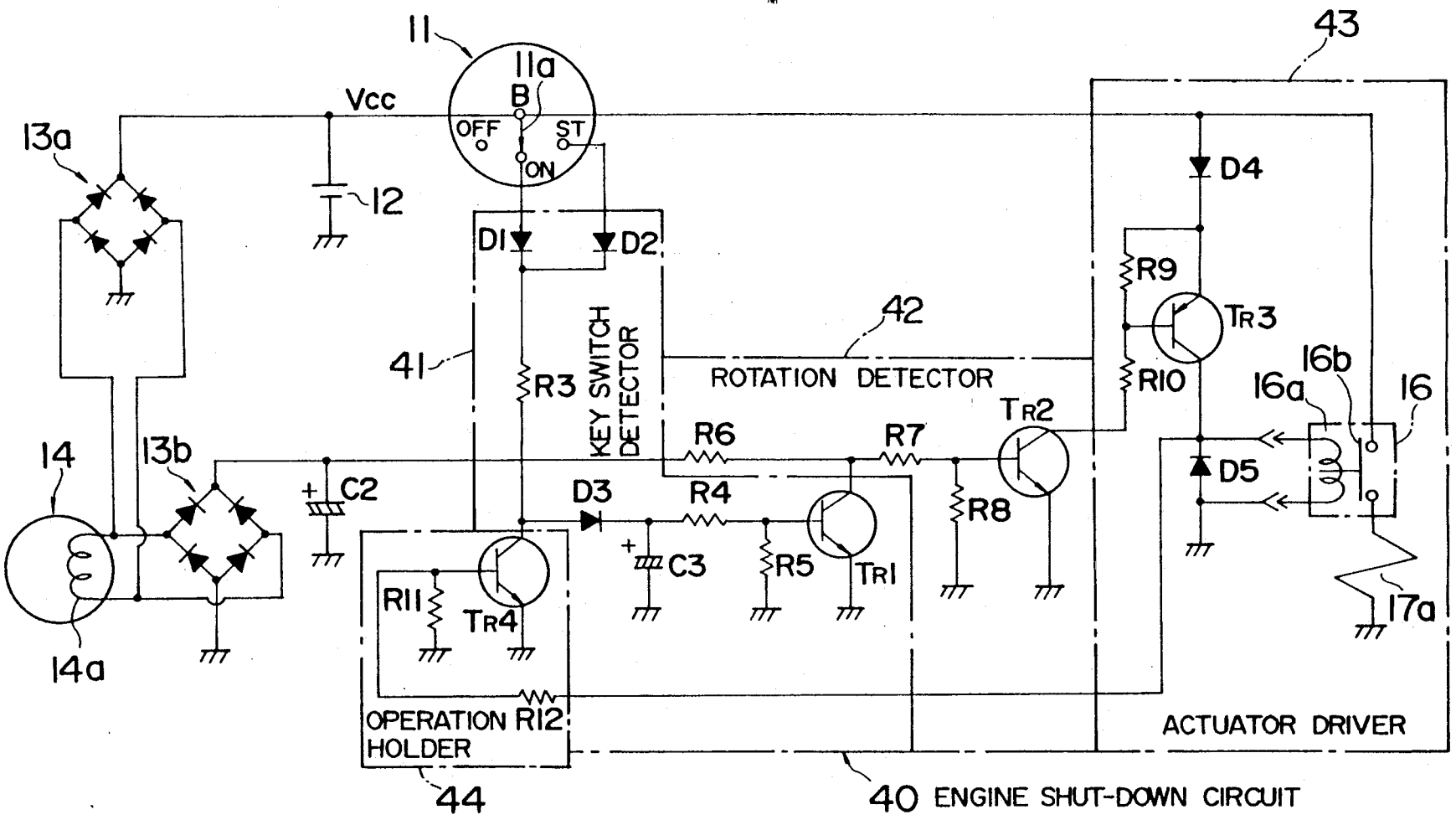
FIG. 4 is a circuit diagram showing an engine shut-down device of a second embodiment of the present invention.

Next, there is described a engine shut-down device according to a second embodiment of the present invention with reference to FIG. 4.

In FIG. 4, components having the same numerals in FIGS. 1 and 2 are the same or equivalent as or to the device of the first embodiment. In the figures, numeral 40 denotes an engine shut-down circuit comprising a key switch detector 41, a rotation detector 42, an actuator driver 43, and an operation holder 44.

The key switch detector 41 comprises diodes D1 and D2 connected with the ON and ST terminals of the key switch 11, respectively, a resistor R3 connected with the diodes D1 and D2, respectively, and a capacitor C3 connected with the resistor R3 through a diode D3.

A resistor R4 is connected with a connecting point of the capacitor C3 and the diode D3, and also with a base of a transistor TR1 and a bias resistor R5.

The rotation detector 42 comprises a resistor R6 connected with a smoothing capacitor C2 and a magneto 14 through a second rectifier 13*b*, a resistor R7 connected with a connecting point of the resistor R6 and a collector of the transistor TR1, an NPN type transistor TR2 connected with the resistor R7 by a base thereof, and a bias resistor R8 connected with a connecting point of the resistor R7 and the base of the transistor TR 2.

The actuator driver 43 comprises a diode D4 connected with a B terminal of the key switch 11, a transistor TR3 connected with the diode D4 through an emitter thereof, resistors R9 and R10 which are connected in series each other and between a collector of the transistor TR2 and the diode D4, a relay switch 16 having an excitation coil 16*a*, and a diode D5 for absorbing a surge o±the excitation coil 16*a* and connected with a collector of the transistor TR3.

The base of the transistor TR3 is connected with a connecting point of the resistors R9 and R10. The surge absorbing diode D5 are connected in parallel to the excitation coil 16*a* of the relay switch 16. The emitter and the base of the transistor TR3 are biased through the resistor R9, and the excitation coil 16*a* is connected with the collecter of the transistor TR3.

A power source Vcc is connected with one of the terminals of a relay contact 16*b* of the relay switch 16, and an excitation coil 17*a* of a solenoid 17 is connected with the other terminal of the contact 16*b*. The solenoid 17 is an engine shut-down actuator.

The operation holder 44 comprises an NPN type transistor TR4 having a collector connected with a connecting point of the resistor R3 and the diode D3, an emitter of which is grounded, and a base of which is connected through a resistor R12 with a point between the diode D5 and the collector of the transitor TR3 in the driver 43, and a bias resistor R11 connected in parallel with the base of the transistor TR4.

The shut-down device 40 according to the second embodiment is applied to the fuel system having the same construction as that of the first embodiment. As the construction of the fuel system is described in the first embodiment, a duplicate description is omitted here.

Next, there will now be described an operation of the device of the second embodiment having the above-mentioned construction.

First, when the contact 11*a* is connected to the ON terminal, the capacitor C3 charges the current from the battery 12 through the diode D1, the resistor R3 and the diode D3 because the transistor TR4 of the operation holder 44 is turned off. The voltage of the capacitor C3 is supplied to the base of the transistor TR1.

Therefore, as the transistor TR1 is turned on and the base voltage of the transistor TR2 becomes a substantially ground level, the transistor TR2 of the rotation detector 42 is turned off, thereby maintaining the next transistor TR3, relay switch 16, and solenoid 17 in the off state.

Next, after the engine starts in accordance with the operation of the starter (not shown) by connecting the contact 11*a* to the ST terminal, the contact 11*a* is returned to connect with the ON terminal by an operator. When the engine starts, an alternating current occurs in the charge coil 14*a* of the magneto 14. An alternating voltage is rectified by the full rectification of the first rectifier 13*a* and charged in the battery 12.

At this time, the output of the charge coil 14*a* of the magneto 14 is rectified by the second rectifier 13*b* and smoothed by the capacitor C2, thereby supplying to the rotation detector 42. On the other hand, since the base current is supplied to the base of the transistor TR1 through the diode D1, the resistor R3 and the diode D3 in the switch detector 41, the capacitor C2 is discharged through the resistor R6 and the transistor TR1 which is turned on, thereby maintaining the transistor TR2 in the rotation detector 42 to be turned off.

At an ordinary operation, as shown in FIG. 3, the control rack 30*a* of the fuel pump 30 moves in dependence on the balance of the governor spring 36 and flyweight (not shown) which pushes the governor shaft 33 by the centrifugal force corresponding to the engine revolution, thereby controlling the engine speed in the steady condition.

When the contact 11*a* is moved from the ON terminal to the OFF terminal to stop the engine, the base current of the transistor TR1 is cut so as to turn off the transistor TR1.

Then, the output of the charge coil 14*a* flows through the resistors R6 and R7 to the resistor R8. The resistor R8 biases the transistor TR2 and the base current flows to turn on the transistor TR2.

Therefore, the transistor TR3 of the actuator driver 43 is turned on to supply the current from the battery 12 to the excitation coil 16*a* of the relay switch 16, thereby turning on the relay contact 16*b*. The current of the battery 12 is supplied to the excitation coil 17*a* of the solenoid 17.

As a result, the plunger 17*b* of the solenoid 17 pulls the stop lever 32 in the clockwise direction, as shown in FIG. 3, and the governor lever 31 is forcibly rotated in a direction of shutting down the engine. The control rack 30*a* of the pump 30 connected to the shaft 31 is operated to interrupt the fuel supply so as to stop the engine.

At this time, while the relay switch 16 is turned on, as the collector of the transistor TR3 becomes a high level and the collector of the transistor TR3 is connected to the base of the transistor TR4, the voltage is supplied to the base of the transistor TR4 of the operation holder 42 through the resistor R11, so as to turn on the transistor TR4.

Accordingly, even if the contact 11*a* is connected to the ON terminal by the wrong operation before the engine completely stops, the current flowing from the source Vcc through the diode D1 is grounded by the transistor TR4 of the operation holder 44 through the resistor R3, thereby turning off the transistor TR1 of the key switch detector 41. The transistor TR2 of the rotation detector 42 and the transistor TR3 of the actuator driver 43 are maintained to be turned on so as to stop the engine certainly.

When the engine completely stops and the charge coil 14*a* does not output at all, the transistor TR2 of the rotation detector 42 is turned off and the transistor TR3 of the actuator driver 43 is turned off, thereby stopping the current supply to the excitation coil 17*a* of the solenoid 17 to return the initial position.

Namely, as the solenoid 17 is turned off immediately after the engine stops completely, it is possible to avoid the wastefull consumption of the electric power and to reduce the load to the battery 12.

Figure 5:
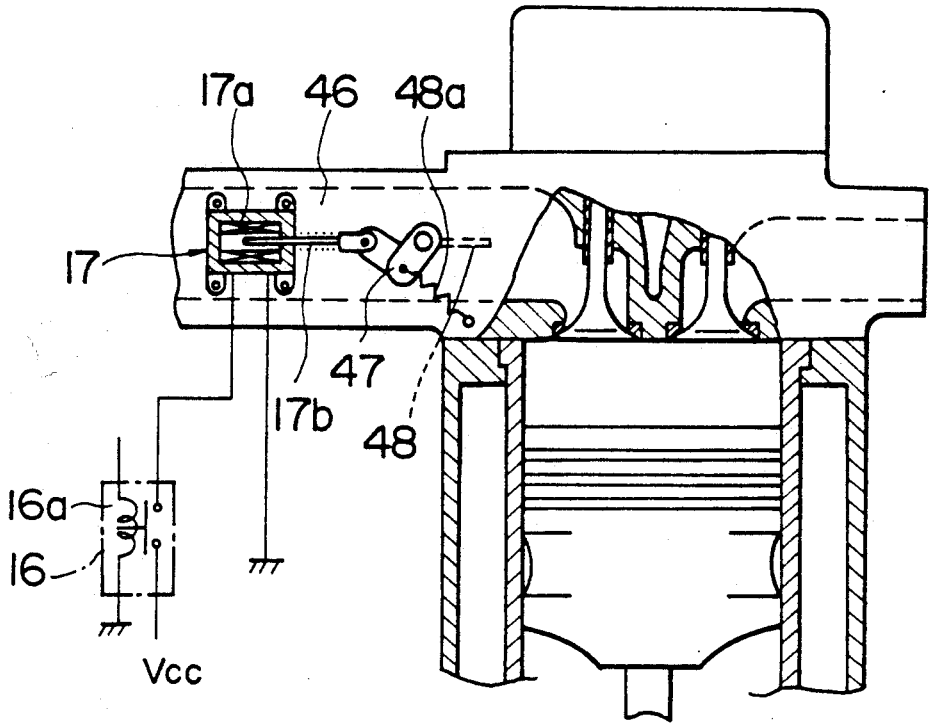
FIG. 5 is a front view showing an intake air system on which an engine shut-down device of a third embodiment is mounted.
Figure 6:
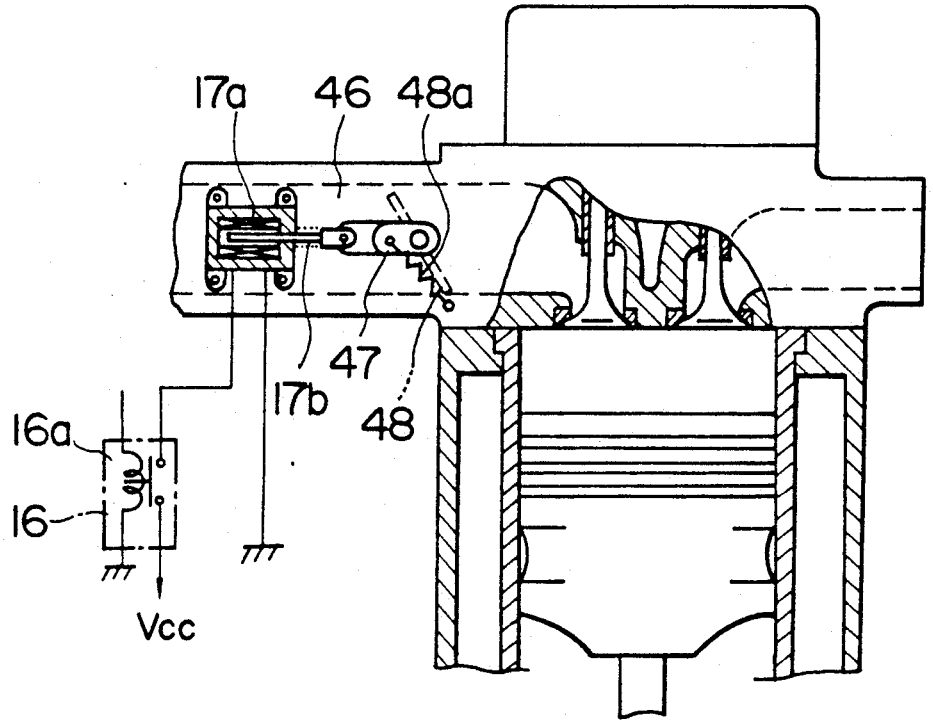
FIG. 6 is a front view of a main portion showing a different condition of the shut-down device of the third embodiment mounted on the intake air system.

Next, there is described an engine shut-down device according to a third embodiment of the present invention with reference to FIGS. 5 and 6.

In the third embodiment, the engine stops by limiting the intake air. When a relay switch 16 provided on an actuator driver 43 of an engine shut-down device 40 is turned on, an electric power is supplied to an excitation coil 17*a* of a solenoid 17 as an engine shut-down actuator which is mounted on an intake air pipe 46. Then, a plunger 17*b* of the solenoid 17 reverses to move a link 47 so as to shut a shut valve 48 which is provided within the pipe 46, thereby stopping the engine, as shown in FIG. 6.

When the relay switch 16 is turned off, the valve 48 opens again by the elastic force of a return spring 48*a* as shown in FIG. 5.

The present invention is not limited in the first to third embodiments. For example, the device of the present invention applies not only to the gasoline engine but also to a diesel engine mounted on the vehicle. The engine shut-down device uses not only the electromagnetic solenoid but also an oil pressure type actuator. Furthermore, in the first and second embodiments, the engine shut-down actuator may directly push the control rack 30*a* of the fuel pump 30 in a direction of stopping the engine. Still furthermore, driving means may directly operate the engine shut-down actuator.

As aforementioned in detail, since the device of the present invention comprises the shut-down controller for outputting the engine shut-down signal in dependency on the rotation signal generated by the engine rotation when the key switch is turned off and for self-holding until the rotation signal stops, and the start controller for non-electrifying the starter while the rotation signal is output regardless of the condition of the key switch, the starter does not operate until the engine completely stops even if the key switch is operated, thereby having the excellent effect to previously avoid the trouble by the improper operation when starting the engine.

Furthermore, as the device of the present invention comprises the key switch detector for detecting a key switch condition by an on/off operation of a switching element and outputting an engine shut-down signal when the key switch is turned off, the operation detector for outputting a driving signal by a detection of the engine rotation based on the engine shut-down signal, the actuator driver for driving the engine shut-down actuator responsive to the driving signal, and an operation holder for cancelling an operation of the key switch detector while the rotation detector outputs the driving signal, the engine shut-down actuator is operated while the engine is rotating at shutting down the engine, thereby avoiding the useless consumption of the current at shutting down the engine. In addition, even if the key switch is turned on by mistake when the engine does not stop completely, the engine does not restart, thereby obtaining the good effect of definitely shutting down the engine.

Still furthermore, the device having an alarm lamp according to the present invention comprises the display for displaying a shortage of the oil quantity, the detection circuit for detecting the shortage of the oil quantity, the delay circuit for outputting an oil quantity shortage signal when the shortage continues in a predetermined time, a display driving circuit for displaying the shortage in the display responsive to the shortage signal, the engine shut-down timer for outputting an engine shut-down signal in a predetermined time in dependency on the shortage signal, and the shut-down driving circuit for outputting an operation signal to the engine shut down actuator while the engine shut-down signal is output from the timer. Accordingly, even if the oil surface is temporarily changed by the sudden start or stop, it is possible to definitely detect the fuel quantity and the lubricating oil quantity by the simple construction, so as to avoid the wrong operation to stop the engine and to alarm the shortage of quantities. Furthermore, when the shortage of the oil quantity is detected, the engine can be immediately stopped to effectively protect the engine from the damage.

While the presently preferred embodiments of the present invention have been shown and described, it is to be understood that these disclosures are for the purpose of illustration and that various changes and modification may be made without departing from the scope of the invention as set forth in the appended claims.

What is claimed is:

1. An engine shut-down control device mounted on an engine having a starter for starting said engine, a key switch operatively connected to said starter for turning said starter on and off, a shut-down actuator provided to shut down said engine, a magneto for generating electric power and for generating an engine rotation signal dependent on engine rotation when said key switch is turned off, and control means for maintaining output of an engine shut-down signal to said shut-down actuator while said engine rotation signal is generated and for simultaneously terminating output of an engine shut-down signal immediately after said magneto stops output of said engine rotation signal in order to release said shut-down actuator, an improvement of the device which comprises:

a waveform shaping circuit responsive to said engine rotation signal for converting an alternating current into a pulse wave by rectifying and for producing a pulse signal;

a conversion circuit responsive to said pulse signal for charging said pulse wave into a pulse frequency and for generating a voltage signal indicative thereof;

a comparison circuit responsive to said voltage signal for comparing said pulse frequency with a reference voltage and for outputting an operational signal;

a starter circuit responsive to said engine shut-down signal and said operational signal for maintaining said starter in a non-electrified condition so as to release said shut-down actuator and to prevent said device from wasting electric power when said engine stops.

2. The device according to claim 1, wherein said control means comprises:

a key switch detector for detecting a position of said key switch and for outputting an engine start signal of said starter when said key switch is turned on; and an operation holder for voiding said engine start signal from said key switch detector while said engine rotation signal is generated.

3. An engine shut-down control device mounted on an engine having a key switch, a starter, and a shut-down actuator provided to shut down said engine, comprising:

generating means for generating an alternating output signal synchronized with the rotation of said engine;

control means for maintaining output of an engine shut-down signal to said shut-down actuator while said generating means generates said alternating output signal and for simultaneously terminating output of said engine shut-down signal when said generating means stops output of said alternating output signal;

a waveform shaping circuit provided to shape said alternating output signal into pulse waves;

a conversion circuit provided to convert the number of said pulse waves to a voltage value corresponding to an engine speed;

a comparison circuit provided to compare said voltage value with a predetermined value representing a predetermined engine speed and to produce an operational signal when said engine rotates; and starter control means for maintaining said starter in a non-electrified condition in response to said operational signal, so as to prevent said starter from damage.

4. The device according to claim 3, wherein said starter control circuit means comprises:

a self hold circuit including a thyrister provided between said generating means and a ground, said thyrister having a gate to which said operational signal is supplied from said comparison circuit for holding a voltage at an anode of said thyrister until said key switch is turned off; and a start circuit including a transistor provided between said starter and ground, said transistor responsive to said voltage at the anode of said thyrister for maintaining said starter in said non-electrified condition.

5. The device according to claim 3, wherein said generating means is a magneto cooperating with said engine.

6. The device according to claim 3, wherein said control means comprises:

a key switch detector for detecting a position of said key switch and for producing a signal which prohibits the output of said engine shut-down signal to said shut-down actuator when said key switch is in ON position; and an operation holder for voiding said signal from said key switch detector while said engine rotation signal is generated, whereby said control means maintains to output said engine shut-down signal to stop said engine even if said key switch is turned on again by the wrong operation before the engine completely stops.

* * * * *